United States Patent [19]

Carter, Jr. et al.

[11] Patent Number: 4,642,910

[45] Date of Patent: Feb. 17, 1987

[54] BOOT WITH DETACHABLE SPUR

[76] Inventors: Nathan B. Carter, Jr., P.O. Box 4324, Meridian, Miss. 39301; Larry F. Ligon, Rt. 3, Box 217, New Albany, Miss. 38652

[21] Appl. No.: 850,548

[22] Filed: Apr. 11, 1986

[51] Int. Cl.[4] ..... A43B 5/00; A43B 23/24; A43C 17/00

[52] U.S. Cl. ..... 36/1; 36/131; 36/137; 54/83 R; 350/98

[58] Field of Search ..... 36/131, 137, 74, 1, 36/136; 54/83 R, 83 A; 350/98

[56] References Cited

U.S. PATENT DOCUMENTS

| | | | |
|---|---|---|---|
| 3,142 | 6/1843 | Reinhart | 54/83 R |
| 32,490 | 6/1861 | Towers | 36/1 |
| 1,977,995 | 10/1934 | Morali | 36/136 X |

FOREIGN PATENT DOCUMENTS

| | | | |
|---|---|---|---|
| 2840821 | 4/1890 | Fed. Rep. of Germany | 54/83 R |
| 2417811 | 9/1979 | France | 36/137 |
| 2737 | of 1864 | United Kingdom | 54/83 R |
| 5935 | of 1890 | United Kingdom | 54/83 R |
| 388973 | 3/1933 | United Kingdom | 36/137 |
| 539119 | 8/1941 | United Kingdom | 350/98 |

*Primary Examiner*—James Kee Chi

*Attorney, Agent, or Firm*—Harvey B. Jacobson

[57] ABSTRACT

A boot provided with a depending rear heel is provided and a rearwardly opening front-to-rear extending blind cavity is defined within the heel. A spur including an elongated shank having first and second end portions is provided and the first end portion of the shank of the spur is releasably latchingly receivable within the cavity defined in the boot. In addition, a decorative button is provided for releasable snap fitting engagement in the rear end of the cavity after the first end portion of the shank of the spur has been removed from the cavity.

8 Claims, 6 Drawing Figures

FIG. 1
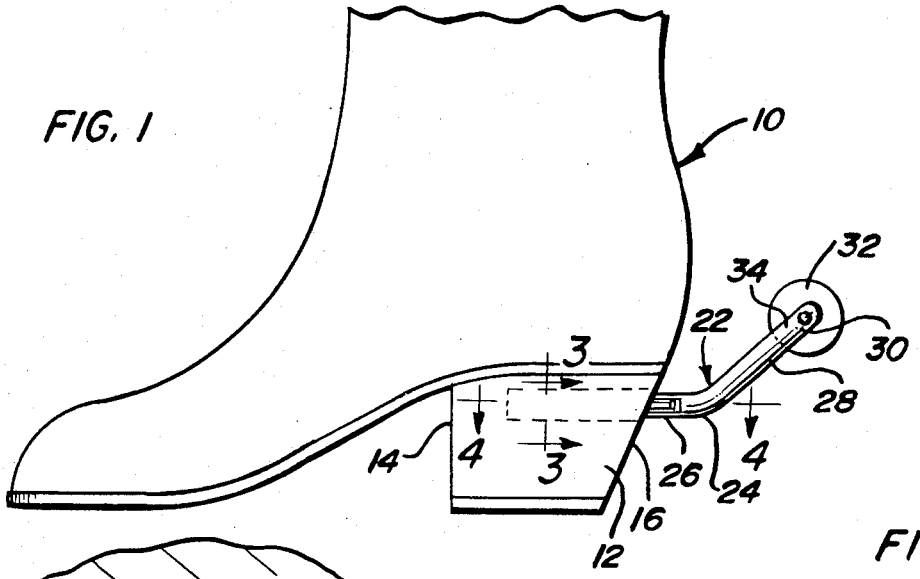
FIG. 3
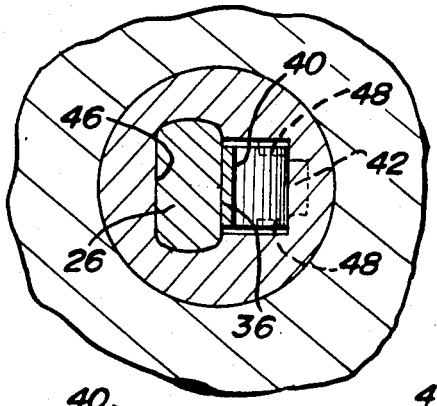
FIG. 2
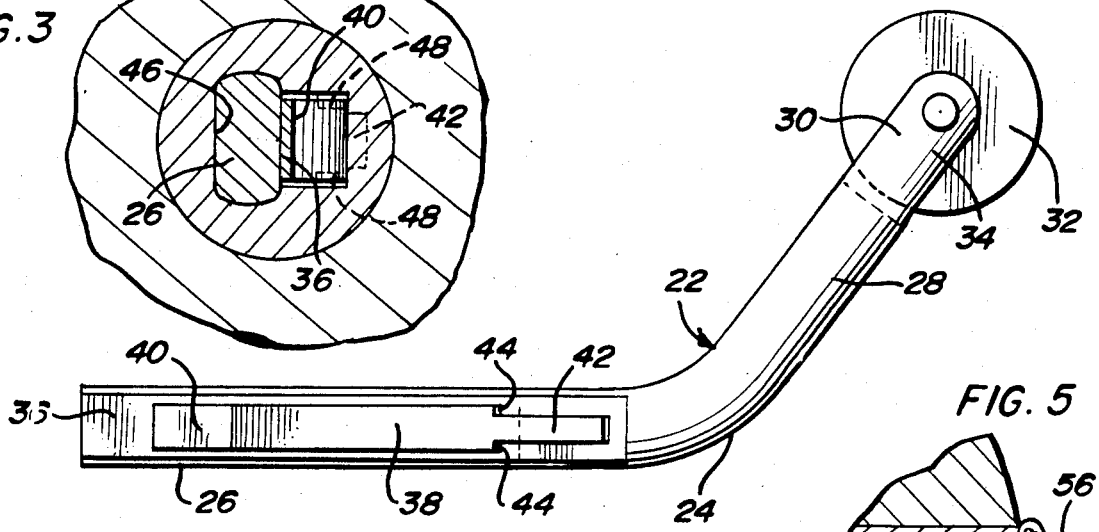
FIG. 5
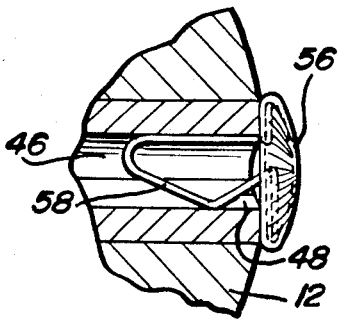
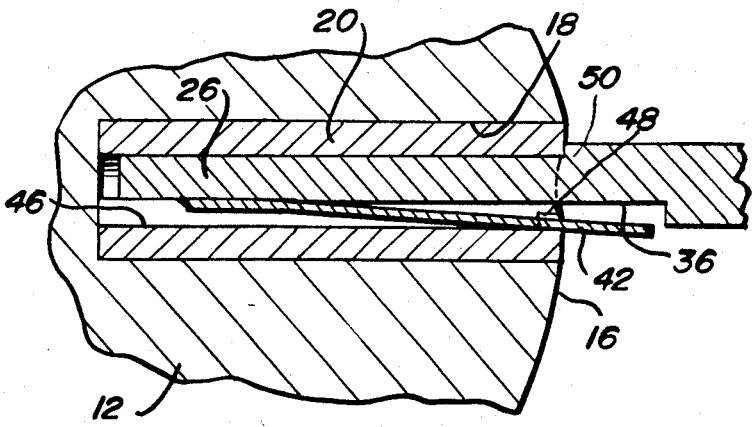
FIG. 4
FIG. 6
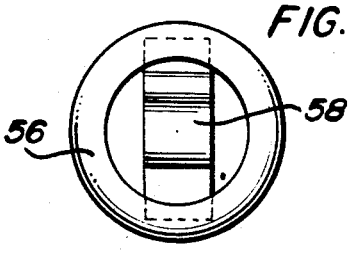

BOOT WITH DETACHABLE SPUR

BACKGROUND OF THE INVENTION

1. Field of the Invention

This invention relates to a spur assembly and a companion boot wherein the boot includes a rear depending heel portion and the spur assembly is removably supported from the heel portion.

2. Description of the Related Art

Various different forms of removable spurs heretofore have been provided for use in conjunction with riding boots of the type including a depending heel. Examples of these previously known forms of boot and spur combinations are disclosed in U.S. Pat. Nos. 39,477, 105,671, 113,152, 116,404, 256,606, 450,512 and 701,854. However, these boot, heel and spur combinations do not include structure whereby a spur may be supported from a boot heel for ready removal therefrom and yet in a manner which will prevent accidental removal of the spur from the boot heel.

SUMMARY OF THE INVENTION

The boot heel and spur combination of the instant invention has been designed to provide a spur supported from a boot heel in a manner enabling ready removal of the spur from the boot heel and yet preventing accidental disengagement of the spur from the boot heel.

The spur may be of any desired configuration and is mounted from the associated boot in a manner to maintain the spur in prodetermined position relative to the boot while still enabling the spur to be readily disengaged from the boot.

The main object of this invention is to provide a boot and spur combination incorporating structure whereby the spur may be readily removed from the boot and yet retained in mounted position relative to the boot against accidental disengagement therefrom.

Another object of this invention is to provide a boot and spur combination in accordance with the preceding object and wherein the spur is removably supported from a depending heel portion of the boot.

Yet another object of this invention is to provide a boot and spur combination incorporating a readily removal spur mounted from a boot heel in a manner such that the spur will be latched in position relative to the boot heel against shifting relative thereto.

Another object of this invention is to provide a boot and spur combination in accordance with the preceding objects and constructed in a manner whereby the boot heel and spur enjoy coacting latch structure whereby the spur may be automatically removably latched in position relative to the boot spur upon easy mounting of the spur upon the boot heel.

Another important object of this invention is to provide a boot and spur combination incorporating readily releasable latch structure for retaining the spur in mounted position upon the associated boot.

A final object of this invention to be specifically enumerated herein is to provide a spur and boot combination in accordance with the preceding objects and which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a fragmentary side elevational view of a boot incorporating a removable spur assembly constructed in accordance with the present invention;

FIG. 2 is an enlarged side elevational view of the spur construc- tion;

FIG. 3 is ap enlarged fragmentary transverse vertical sectional view taken substantially upon the plane indicated by the sectional line 3—3 of FIG. 1;

FIG. 4 is a fragmentary enlarged horizontal sectional view taken substantially upon the plane indicated by the section line 4—4 of FIG. 1;

FIG. 5 is a fragmentary enlarged horizontal sectional view of the rear portion of the boot heel illustrated in FIG. 1 illustrating the manner in which a removable decorative button may be supported from the heel when the spur assembly is removed; and FIG. 6 is an enlarged elevational view of the decorative button as seen from the left side of FIG. 5.

DESCRIPTION OF THE PREFERRED EMBODIMENT

Referring now more specifically to the drawings, the numeral 10 generally designates a boot of conventional construction including a rear depending heel 12 having front and rear sides 14 and 16.

The heel includes a front-to-rear extending blind bore 18 formed therein and opening rearwardly through the rear side 16. The bore 18 may comprise a rough surface bore and a sleeve 20 is inserted in the bore 18 to at least substantially the full depth thereof and is secured within the bore 18 through the utilization of an adhesive (not shown). In order to increase the adhesive bond between the sleeve 20 and the blind bore 18, the sleeve 20 may include a knurled external surface (not shown).

A spur referred to in general by the reference numeral 22 is provided and includes an elongated shank 24 having first and second relatively angulated end portions 26 and 28. The terminal end 30 of the end portion 28 is bifurcated and rotatably journals a disc 32 between the furcations 34 thereof and the first end portion 26 includes a radially outwardly opening and longitudinally extending relieved area 36. The relieved area 36 comprises a flat and extends substantially the full length of the end portion 26. In addition, an elongated resilient spring arm keeper 38 is provided and includes a first end 40 secured in the end of the relieved area 36 remote from the shank end portion 28. The spring arm keeper 38 is slightly bowed in its static condition and includes a narrowed second end 42 on its end remote from the first end 40. The narrowed end 42 defines a finger engageable tongue and a pair of endwise outwardly facing opposite side shoulders 44.

The sleeve 20 defines an elongated cavity 46 extending longitudinally therethrough and the cavity 46 is non-circular in cross-sectional shape. The cross-sectional shape of the cavity 46 is generally keyhole shaped and the outer end portion of the sleeve 20 defines a pair of opposite side abutments 48.

The spring arm keeper 38 and portion 26 of the shank 24 together define a cross-sectional shape which corresponds to the cross-sectional shape of the cavity 46. The end portion 26 is snugly lengthwise telescopingly receivable within the cavity 46 from the rear end of the sleeve 20 to the position thereof illustrated in FIG. 4 of the drawings. The side of the end portion 26 remote from the relieved area 36 defines a shoulder 50 which abuts against the outer end of the sleeve 20 to limit penetration of the end portion 26 into the cavity 46 and as the end portion 26 is telescoped into the cavity 46, the abutments 48 engage the opposite sides of the spring arm keeper 38 to deflect the second end into the relieved area 36. In addition, as the shoulder 50 abuts the outer end of the sleeve 20, the shoulders 44 pass immediately inwardly of the abutments 48 thus allowing the narrowed end 42 of the spring arm keeper 38 to swing slightly outwardly of the relieved area 36 to thus position the shoulders 44 behind the inner portions of the abutments 48. In this manner, the end portion 26 of the shank 24 is releasably retained within the sleeve 20 against accidental withdrawal therefrom. Further, the corresponding non-circular cross-sectional shapes of the cavity 46 and end portion 26 prevent rotation of the end portion 26 about its longitudinal axis relation to the sleeve 20.

When it is desired to remove the spur 22 from the boot 10, digital pressure is applied to the narrowed end 42 in order to displace the latter inwardly toward a fully seated position within the relieved area 36. This causes the shoulders 44 to be displaced inwardly toward the center of the cavity 46 from the abutments 48 and thereby enables the end portion 26 of the shank 24 to be withdrawn from the cavity 46.

The end portion 28 is angulated generally 45° relative to the end portion 26 and a decorative button 56 is provided and includes a leaf spring catch 58 removably snap fittingly engageable within the outer end of the cavity 46 after the end portion 26 has been withdrawn from the cavity 46. The leaf spring catch 58 is snap fittingly engageable behind the abutments 48 and is therefore removably engageable with the heel 12 in order to close the rear end of the cavity 46 when the spur 22 has been removed.

If it is desired to again install the spur 22 after the decorative button 56 has been placed in position, the decorative button 56 is pried from the outer end of the cavity 46 and the end portion 26 of the spur 22 is lengthwise telescoped into the cavity 46 to the position illustrated in FIG. 4.

The spur 22 preferably will be constructed of any suitable metal which resists corrosion and the decorative button 56 may be formed of a similar material. However, other suitable materials may be used in the construction of the spur 22 and the decorative button 56.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A boot with a detachable spur, said boot incorporating a depending heel including an upstanding rear side, means defining an elongated cavity in said heel opening lengthwise outwardly through said rear side and of non-circular cross-sectional shape, an elongated shank including first and second end portions, said second end portion defining said spur, said first end portion being of a non-circular cross-sectional shape complementary to the first mentioned non-circular cross-sectional shape, one side of said first end portion including an elongated relieved area extending longitudinally therealong and including first and second ends remote from and adjacent said second end portion, respectively, an elongated spring arm keeper including a first end anchored in the first end of said relieved area remote from said second end portion and with said spring arm keeper extending longitudinally along said relieved area toward said second end portion and including a second end curving outwardly of said relieved area and resiliently laterally displaceable into said second end of said relieved area, said first end portion and said spring arm keeper being freely longitudinally displaceable into said cavity when said second end of spring arm keeper is fully displaced into said second end of said relieved area, said second end of said spring arm keeper and said means defining said cavity including first and second coacting abutment means, respectively, operative, when said second end of said keeper is only partially displaced into said relieved area, to prevent longitudinal displacement of said first end portion of said shank from said cavity, said first coacting means being carried by said second end of said spring arm keeper a spaced distance longitudinally therealong from the terminal end of said second end of spring arm keeper, said terminal end, when said first end portion of said shank is displaced into said cavity to a position with said first and second abutment means coacting with each other to prevent displacement of said shank first end portion from said cavity, projecting rearward of said rear side for manual digit pressure thereon to displace terminal end fully into said relieved area.

2. The boot of claim 1 wherein said spur comprises a generally smooth periphery rowel journalled from said second end portion for rotation about a horizontal axis extending transversely of said second end portion.

3. The boot of claim 1 wherein said second end portion is relatively inclined generally 45° relative to said first end portion and said first and second end portions are disposed in an upstanding plane.

4. The boot of claim 1 including a decorative button removably snap fittingly engageable within the end of said cavity opening outwardly through the rear side of said heel when said first end portion of said shank is removed from said cavity.

5. The boot of claim 1 wherein said heel includes a front-to-rear extending blind bore formed therein opening rearwardly said through rear side and said cavity is defined by the interior of a tubular sleeve secured in said bore.

6. The boot of claim 5 wherein said spur comprises a generally smooth periphery rowel journalled from said second end portion for rotation about a horizontal axis extending transversely of said second end portion.

7. The boot of claim 5 wherein said second end portion is relatively inclined generally 45° relative to said first end portion and said first and second end portions are disposed in an upstanding plane.

8. The boot of claim 1 including a decorative button removably snap fittingly engageable within the end of said cavity opening outwardly through the rear side of said heel when said first end portion of said shank is removed from said cavity.

* * * * *